US007280074B1

(12) United States Patent
Chi et al.

(10) Patent No.: US 7,280,074 B1
(45) Date of Patent: Oct. 9, 2007

(54) MULTIPLE FREQUENCY BAND PLANAR ANTENNA

(75) Inventors: Sheng-Yuan Chi, Banciao (TW); Chia-Bin Yang, Taipei (TW); Shiwei Wang, Taipei (TW)

(73) Assignee: Delta Networks, Inc., Taipei (TW)

( * ) Notice: Subject to any disclaimer, the term of this patent is extended or adjusted under 35 U.S.C. 154(b) by 7 days.

(21) Appl. No.: 11/394,962

(22) Filed: Mar. 30, 2006

(51) Int. Cl.
*H01Q 1/38* (2006.01)

(52) U.S. Cl. ..... 343/700 MS; 343/702

(58) Field of Classification Search ..... 343/700 MS, 343/702, 846

See application file for complete search history.

(56) References Cited

U.S. PATENT DOCUMENTS 6,535,167 B2 3/2003 Masuda et al. ..... 343/700 MS
6,812,892 B2 * 11/2004 Tai et al. ..... 343/700 MS
6,985,114 B2 * 1/2006 Egashira ..... 343/702
7,057,560 B2 * 6/2006 Erkocevic ..... 343/700 MS

* cited by examiner

*Primary Examiner*—Hoang V. Nguyen
(74) *Attorney, Agent, or Firm*—J.C. Patents

(57) ABSTRACT

A multiple frequency band planar antenna formed on one-side surface of a circuit board comprises: a first antenna pattern, a second antenna pattern, a third antenna pattern and a fourth antenna pattern, each antenna pattern further comprising an elongated portion and a conductor portion; wherein the second elongated portion at a point between its two ends is short-circuited to a feeding transmission line formed on another-side surface of the circuit board through a via. Thus, the multiple frequency band planar antenna can operate at three frequency bands with their central frequencies at 2.4 GHz, 3.5 GHz and 5.8 GHz, respectively, suitable for both WIFi LAN and WiMAX MAN applications.

12 Claims, 8 Drawing Sheets

MULTIPLE FREQUENCY BAND PLANAR ANTENNA

BACKGROUND OF THE INVENTION

1. Field of the Invention

The present invention generally relates to a planar antenna, and more particularly, to a multiple frequency band planar antenna.

2. Description of Related Art

As the wireless internet access technology continues to evolve, users are able to access the internet at a higher speed at a fixed place where an internet station is located, such as, a train station, a university, etc., within a wireless local area network (WLAN). As a result, the wireless notebook has become a mainstream product in the notebook market because it allows users to freely access the internet, compared with the traditional notebook with wire internet access. Recently, a WiFi wireless Local Area Network (LAN) has been developed, which operates at about 2.4 GHz and ~5 GHz (this frequency is referred to as a communication carrier frequency modulated by data signals with any modulation technology, such as an orthogonal frequency division multiplex (OFDM) technology). However, the wireless WiFi LAN technology has some drawbacks which limit its usage to only the neighbourhood of the aforementioned fixed place. These drawbacks include, for example, a low capacity and a short communication range (about several hundred meters) for wireless communication carriers, which limits the users to access the internet to a limited range away from the Internet station. Currently, a wireless WiMAX communication technology (i.e. IEEE 820.16 standard) has been developed to overcome the drawbacks of the wireless WiFi LAN technology; that is, WiMAX allows wireless communication carriers to have a higher capacity and a longer communication range without a significant attenuation so as to make it feasible to access the Internet at any place in a metropolitan area in which a WiMAX metropolitan area network (MAN) is constructed. Moreover, currently, the wireless internet-access technology employs several frequency bands with their operating frequencies at 2.4 GHz, 3.5 GHz, 5.15~5.35 GHz and 5.8 GHz, respectively. Among these frequencies, 2.4 GHz, 5.25 GHz and 5.8 GHz are applied in the WiFi LAN while 2.3~2.5 GHz, 3.5 GHz, 5.15~5.35 GHz and 5.8 GHz are applied in the WiMAX MAN. Accordingly, in response to the need for both WiFi LAN and WiMAX MAN applications, a planar antenna with its operating frequencies at least including 2.4 GHz and 5.15~5.35 GHz can be a suitable one. This broadband antenna is referred to as a multiple frequency broadband antenna.

Furthermore, a planar antenna is widely employed in the wireless communication technology because it is easily integrated with a printed circuit board (PCB), which, for example, is a glass-epoxy or Teflon-glass circuit board, so as to achieve compactness and low cost. For example, U.S. Pat. No. 6,535,167 B2 disclosed a laminate pattern antenna capable of operating at a wider frequency band. The laminate pattern antenna comprises an inverted-F-shaped antenna pattern formed as a driven element on the obverse-side surface of a PCB, and an inverted-L-shaped antenna pattern formed as a passive element on the reverse-side surface of the PCB. By virtue of setting a path length of the inverted-F-shaped antenna pattern to a specific value, this antenna makes the low-frequency side of its usable frequency range shift to the low-frequency side. Likewise, by virtue of setting a path length of the inverted-L-shaped antenna pattern to another specific value, this antenna makes the high-frequency side of its usable frequency range shift to the high-frequency side. As a result, the laminate pattern antenna is able to operate at a wider frequency band; however, its operating frequency is about 2.4 GHz, which limits its application to only WiFi LAN, but not WiMAX MAN. Besides, as the laminate pattern antenna has a complicated structure, its fabricating procedures are accordingly lengthy because they comprise procedures for forming the inverted-F-shaped antenna pattern and then the inverted-L-shaped antenna pattern on both surfaces of the PCB, which in turn increases a fabricating cost. Accordingly, the laminate pattern antenna fails to meet a compactness requirement of a planar antenna due to its laminated structure, in addition to its narrow frequency band. Hence, the design of a novel pattern planar antenna that has multiple frequency bands, a simple antenna structure and a low fabricating cost is highly desired.

SUMMARY OF THE INVENTION

Accordingly, the present invention is directed to a multiple frequency band antenna.

The present invention is further directed to a multiple frequency broad-band antenna with an operating frequency ranging from 2.4 GHz to 5.8 GHz (or near 6 GHz) suitable for both WIFi LAN and Wi MAX MAN applications.

Based on the above mentioned objective or other objectives, a multiple frequency band planar antenna of the present invention is provided on the reverse-side surface of a circuit board (for example, a glass-epoxy circuit board). In addition, the multiple frequency band planar antenna comprises a first antenna pattern and a second antenna pattern, wherein the first antenna pattern comprises a first elongated portion and a first conductor portion, and the second antenna pattern comprises a second elongated portion and a second conductor portion. Besides, the first conductor portion is connected at one end to a ground pattern and is also connected at another end to the end of the first elongated portion opposite to the open end thereof. In addition, the second; conductor portion is connected at one end to one point between one end and another end of the first elongated portion, and is also connected at another end to the end of the second elongated portion opposite to the open end thereof. Moreover, the second elongated portion at a point between its two ends is short-circuited to a feeding transmission line formed on the obverse-side surface of the circuit board through a via. The first and the second elongated portions are substantially parallel with an edge of circumference of the ground pattern with a connecting portion extending to the second elongated portion and covering the via. A high frequency AC signal passes from the feeding transmission line into the second elongated portion through the via.

By virtue of this planar antenna structure, the first antenna pattern forms a first resonant structure that serves as a quarter-wavelength monopole antenna, and the first antenna pattern, the second antenna pattern, the connecting portion as well as the ground pattern form a second resonant structure that serves as a loop antenna with its periphery length equal to one wavelength. Besides, the quarter-wavelength and the one wavelength have their frequencies at 2.45 GHz and 5.28 GHz, respectively. As a result, the multiple frequency band planar antenna is able to operate at least two frequency bands with their central frequencies at 2.45 GHz and 5.28 GHz, respectively, which are within the range of the WiFi LAN and WiMAX MAN's operating frequencies, thereby allowing the multiple frequency band planar antenna to be applied to both WiFi LAN and WiMAX MAN applications.

According to the second embodiment of the present invention, a multiple frequency band planar antenna of the present invention is provided on the reverse-side surface of a circuit board (for example, a glass-epoxy circuit board). The multiple frequency band planar antenna further comprises a first antenna pattern, a second antenna pattern, a third antenna pattern and a fourth antenna pattern. Wherein the first antenna pattern comprises a first elongated portion and a first conductor portion, the second antenna pattern comprises a second elongated portion and a second conductor portion, the third antenna pattern comprises a third elongated portion and a third conductor portion and the fourth antenna pattern comprises a fourth elongated portion and a fourth conductor portion. Besides, the first conductor portion is connected at one end to a ground pattern and is also connected at another end to the end of the first elongated portion opposite to the open end thereof. In addition, the second conductor portion is connected at one end to one point between one end and another end of the first elongated portion, and is also connected at another end to the end of the second elongated portion opposite to the open end thereof. Moreover, the second elongated portion at a point between its two ends is short-circuited to a feeding transmission line formed on the obverse-side surface of the circuit board through a via. Furthermore, the third conductor portion is connected at one end to one point between one end and another end of the first elongated portion, and is also connected to the end of the third elongated portion opposite to the open end thereof. Besides, the fourth conductor portion is connected at one end to the open end of the second elongated portion, and is also connected at another end to the end of the fourth elongated portion opposite to the open end thereof. Additionally, the ground pattern comprises a connecting portion extending over the second elongated portion and covering the via. The first, the second, the third and the fourth elongated portions are substantially parallel with an edge of circumference of the ground pattern. A high-frequency AC signal passes from the feeding transmission line into the second elongated portion through the via. By virtue of this planar antenna structure, it is able to operate at three frequency bands with their central frequencies at 2.4 GHz, 3.5 GHz and 5.8 GHz, respectively, suitable for both WIFi LAN and WiMAX MAN applications.

The objectives, other features and advantages of the invention will become more apparent and easily understood from the following detailed description of the invention when taken in conjunction with the accompanying drawings.

DESCRIPTION OF THE EMBODIMENTS

Figure 1A:
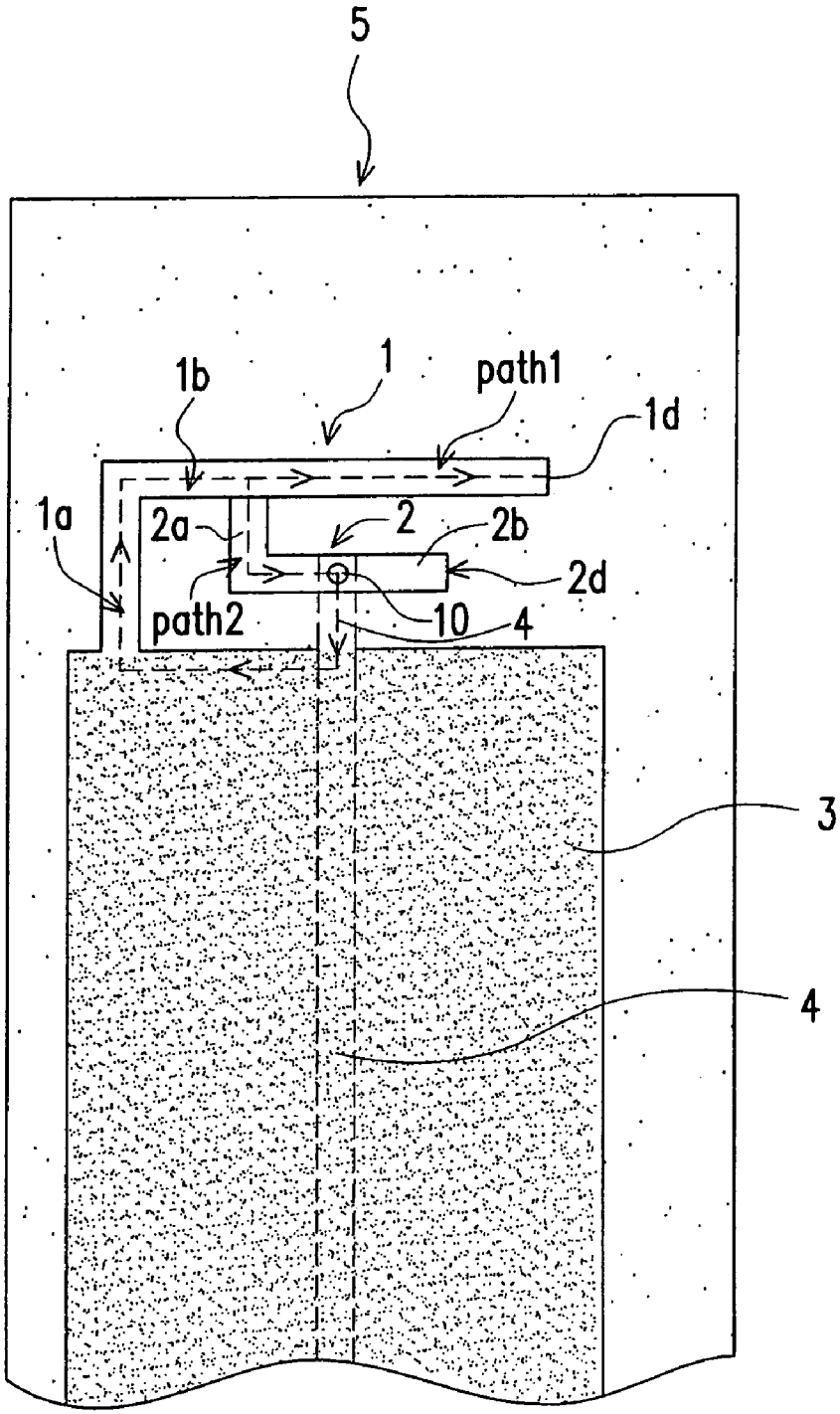
FIG. 1A and FIG. 1B shows a bottom view and a top view of a circuit board that implements a multiple frequency band planar antenna of a first embodiment of the present invention, respectively.

Reference will now be made in detail to a multiple frequency band planar antenna, examples of which are illustrated in the accompanying drawings. Wherever possible, the same reference numbers are used in the drawings to be referred to the same parts.

The First Embodiment

Figure 1B:
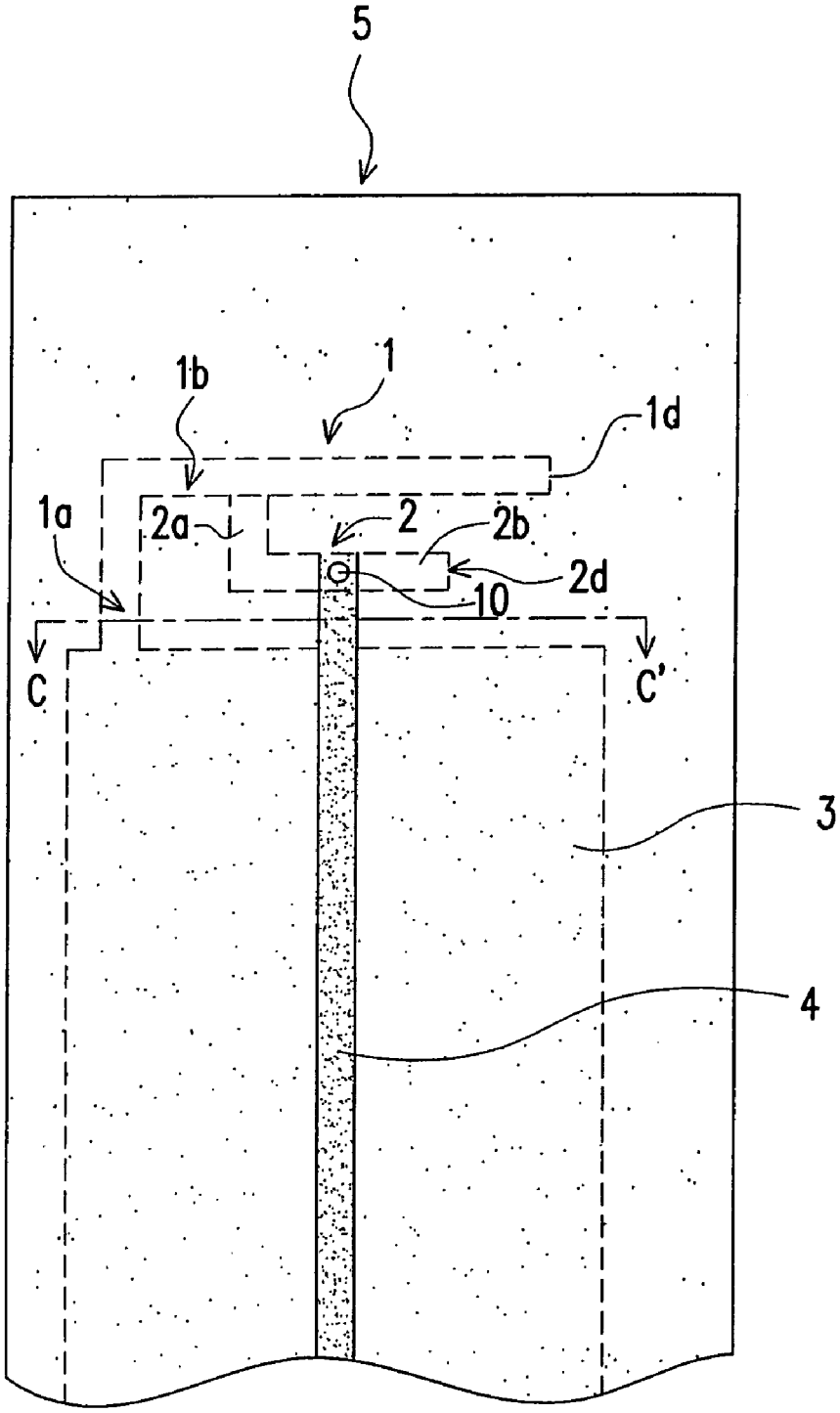
Figure 1C:
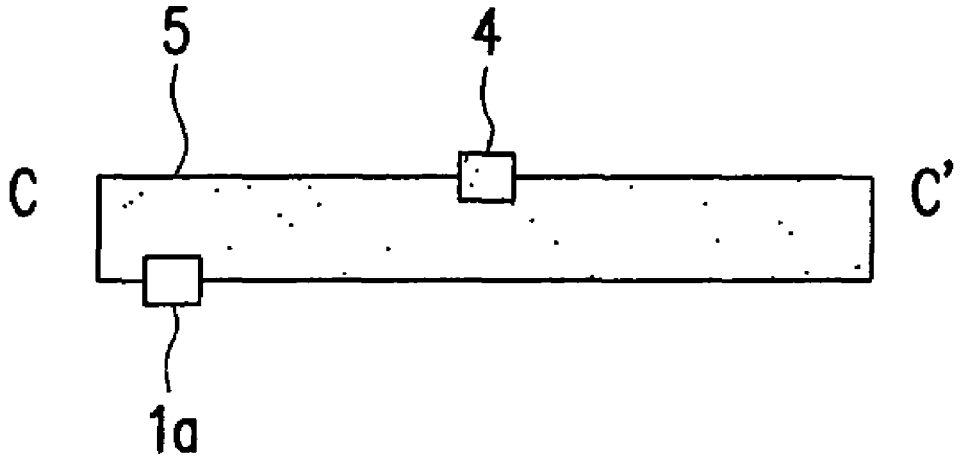
FIG. 1C shows a cross-sectional view taken along the line C-C' shown in FIG. 1B.

FIG. 1A and FIG. 1B respectively shows a bottom view and a top view of a circuit board (for example, a glass-epoxy or Teflon-glass circuit board) that implements the multiple frequency band (MFB) planar antenna of the first embodiment of the present invention. From FIG. 1A, the MFB planar antenna formed on the reverse-side surface of the circuit board 5 comprises a first antenna pattern 1 and a second antenna pattern 2, wherein the first antenna pattern 1 may be, for example, an inverted-L-shaped planar antenna, and so is the second antenna pattern 2. Moreover, the first antenna pattern 1 comprises a first elongated portion 1*b* and a first conductor portion 1*a*, and the second antenna pattern 2 comprises a second elongated portion 2*b* and a second conductor portion 2*a*. Besides, the first conductor portion 1*a* is connected at one end to a ground pattern 3 and is also connected at another end to the end of the first elongated portion 1*b* opposite to the open end 1*d* thereof. In addition, the second conductor portion 2*a* is connected at one end to one point between one end and another end of the first elongated portion 1*b*, and is also connected at another end to the end of the second elongated portion 2*b* opposite to the open end 2*d* thereof. Moreover, the second elongated portion 2*b* at a point between its two ends is short-circuited to a feeding transmission line 4 formed on the obverse-side surface of the circuit board through a via 10. FIG. 1C shows a cross-sectional view taken along the line C-C' shown in FIG. 1B. Accordingly, from FIG. 1C, the first connector portion 1*a* and the feeding transmission line 4 are disposed on the reverse-side surface and the obverse-side surface of the circuit board 5, respectively, so that a high frequency AC signal passes through the feeding transmission line 4 into the second elongated portion 2*b* through the via 10. The first and the second elongated portions 1*b*, 2*b* are substantially parallel with an edge of circumference of the ground pattern.

By virtue of this planar antenna structure, the first antenna pattern 1 forms a first resonant structure (path 1 shown in FIG. 1A) that serves as a quarter-wavelength monopole antenna, wherein the length of the path 1 is designed to be equal to $\lambda/4$ of the 2.4 GHz frequency so as to generate a specific standing wave at 2.4 GHz frequency. Likewise, path 2, as shown in FIG. 1A, can be regarded as a second resonant structure (or a loop antenna), which comprises a first conductor portion 1*a*, a first elongated portion 1*b*, a second conductor portion 2*a*, a second elongated portion 2*b*, and the ground pattern 3, wherein there forms an equivalent EM (electromagnetic) path between the second elongated portion 2*b* and the ground pattern 3 due to the occurrence of the coupling effect therebetween. Besides, the loop antenna with its periphery length is equal to one wavelength. The preceding λ/4 and the one wavelength are chosen to have their corresponding frequencies at 2.45 GHz and 5.28 GHz, respectively. As a result, the multiple frequency band planar antenna is able to operate at two frequency bands with their central frequencies at 2.45 GHz and 5.28 GHz, respectively. As mentioned above, the WiMAX MAN and the WiFi LAN operate at 2.3~2.5 GHz or 5.1~5.35 GHz. Accordingly, the MFB planar antenna of the first embodiment can be implemented in both the WiFi LAN and the WiMAX MAN because the central frequencies of 2.45 GHz and 5.28 GHz of the MFB planar antenna 1 are within the ranges of 2.36~2.5 GHz and 5.1~5.35 GHz, respectively.

Accordingly, not only can the MFB planar antenna of the present invention be applied to both the WiFi LAN and the WiMAX, in addition to the WiFi LAN application in the U.S. Pat. No. 6,535,167 B2, it has a more simplified antenna structure than that of U.S. Pat. No. 6,535,167 B2. As the wireless internet access network has high demands for a higher capacity, multiple frequency bands and a longer communication range, the WiMAX MAN has been developing to replace the WiFi LAN in the next 12-16 months. However, prior to the popular use of WiMAX MAN, currently, both the WiFi LAN and the WiMAX MAN are used simultaneously. Accordingly, the MFB planar antenna of the present invention can allow both the WiFi LAN and the WiMAX MAN to be used simultaneously.

The Second Embodiment

Figure 2A:
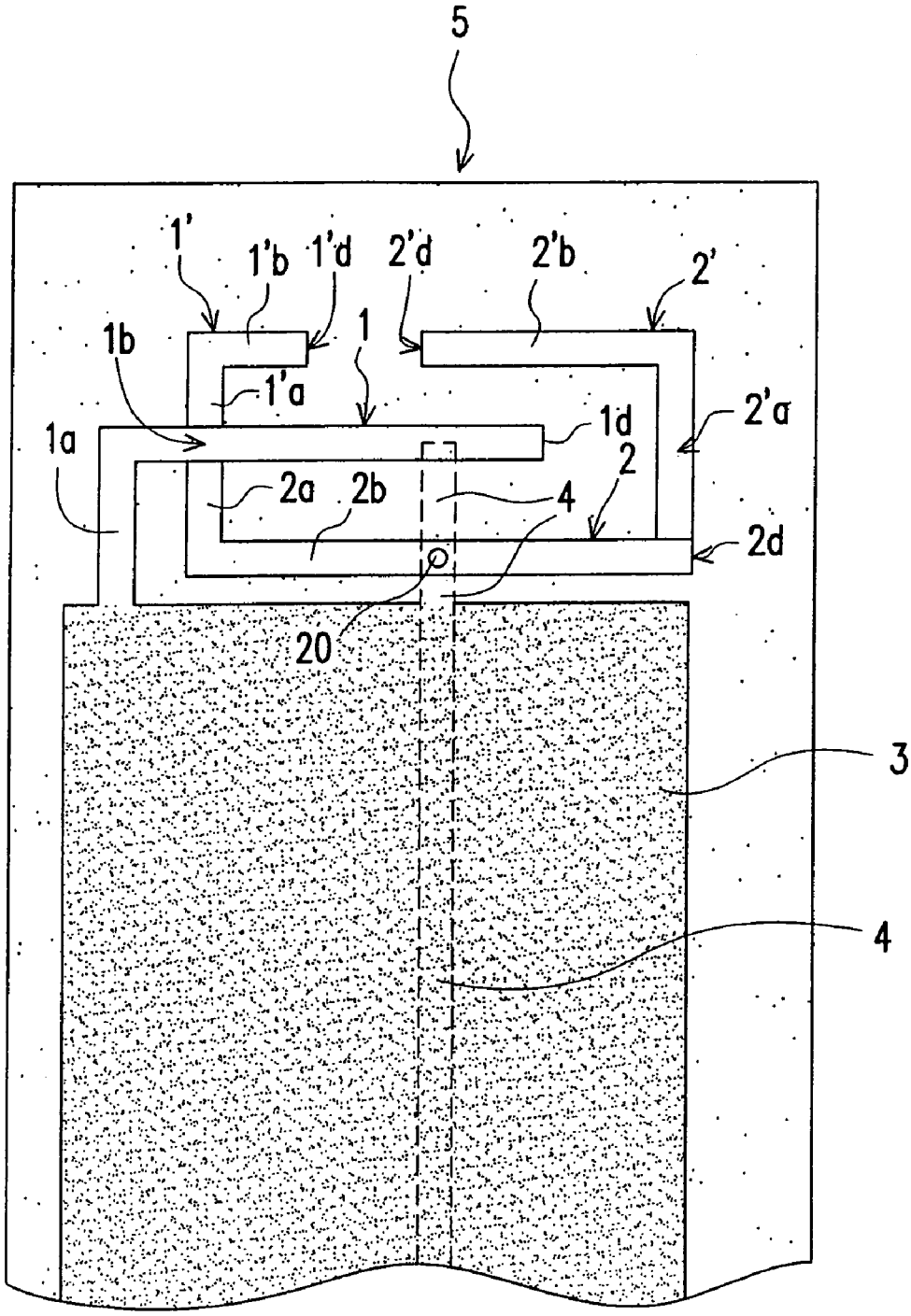
FIG. 2 A and FIG. 2B shows a bottom view and a top view of a circuit board that implements a multiple frequency band planar antenna of a second embodiment of the present invention, respectively.
Figure 2B:
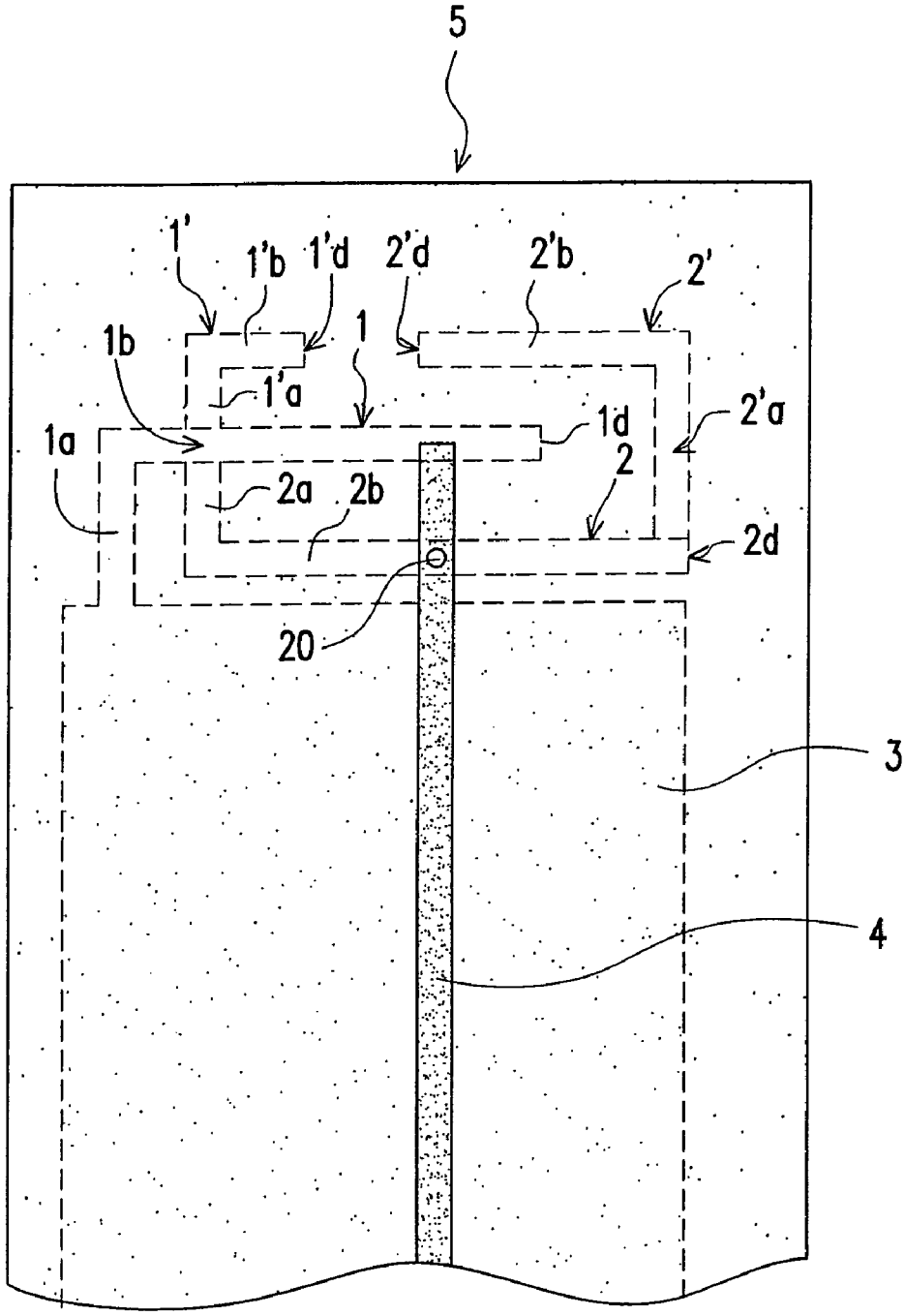

Referring to FIGS. 2A and 2B, they shows a bottom view and a top view of a circuit board (for example, a glass-epoxy or Teflon-glass circuit board) that implements a multiple frequency band planar antenna of a second embodiment of the present invention, respectively. The MFB planar antenna formed on the reverse-side surface of the circuit board 5 comprises a first antenna pattern 1, a second antenna pattern 2, a third antenna pattern 1' and a fourth antenna pattern 2'. Wherein the first antenna pattern 1 comprises a first elongated portion 1*b* and a first conductor portion 1*a*, the second antenna pattern 2 comprises a second elongated portion 2*b* and a second conductor portion 2*a*, the third antenna pattern 1'comprises a third elongated portion 1'*b* and a third conductor portion 1'*a*, and the fourth antenna pattern 2'comprises a fourth elongated portion 2'*b* and a fourth conductor portion 2'*a*. Besides, the first conductor portion 1*a* is connected at one end to a ground pattern 3, and is also connected at another end to the end of the first elongated portion 1*b* opposite to the open end 1*d* thereof.

Additionally, the second conductor portion 2*a* is connected at one end to one point between one end and another end of the first elongated portion 1*b*, and is also connected at another end to the end of the second elongated portion 2*b* opposite to the open end 2*d* thereof. Moreover, the second elongated portion 2*b* at a point between its two ends is short-circuited to a feeding transmission line 4 formed on the obverse-side surface of the circuit board 5 through a via 20. The third conductor portion 1'*a* is connected at one end to one point between one end and another end of the first elongated portion 1*b*, and is also connected at another end to the end of the third elongated portion 1'*b* opposite to the open end 1'*d* thereof. The fourth conductor portion 2'*a* is connected at one end to the open end 2*d* of the second elongated portion 2*b*, and is also connected at another end to the end of the fourth elongated portion 2'*b* opposite to the open end 2'*d* thereof. In addition, the first elongated portion 1*b*, the second elongated portion 2*b*, the third elongated portion 1'*b* and the fourth elongated portion 2'*b* are not overlapped with one another and substantially parallel with an edge of circumference of the ground pattern 3. A high-frequency AC signal passes from the feeding transmission line 4 into the second elongated portion 2*b* through the via 20. By virtue of this planar antenna structure, it is able to operate at three frequency bands with their central frequencies at 2.4 GHz, 3.5 GHz and 5.8 GHz, respectively, suitable for both WIFi LAN and Wi MAX MAN applications.

Accordingly, the MFB planar antennas of the preceding first and second embodiments are able to allow the high-frequency AC signal modulated by data signals with the OFDM technology to be converted to an electromagnetic wave with two or more frequency bands. The electromagnetic wave is in turn used as a communication carrier wave with the same frequency as the AC signal.

When evaluating performances of the MFB planar antennas of the first and second embodiments, some of the significant characteristics must be taken into account, which include antenna gain, radiation pattern and the number of the available frequency bands. The term "frequency band" used in the specification inherently refers to "usable frequency band." Referring to FIG. 3 and FIG. 4, they are different return loss vs. frequency graph patterns that correspond to the MFB planar antennas of the first embodiment and the second embodiment, as shown in FIG. 1A and FIG. 2A, respectively. The "frequency band" is defined as a usable frequency band in which all frequencies have their corresponding return loss less than −10 dB. Besides, the return losses are measured at the feeding transmission line 4, and calculated by the following equation:

$$\text{Return loss}=20\log|\Gamma| \quad (1)$$

Wherein Γ is a reflection coefficient and is equal to a ration of the voltage of the reflected AC signal to that of the incident AC signal at the feeding transmission line 4; that is, the return loss is used to indicate how much the AC signal is turned back when entering the antenna structure. Moreover, according the equation (1), -10 dB return loss means that the original AC signal in the feeding transmission line 4 is returned by a factor of ⅓ after entering the antenna structure.

Figure 3:
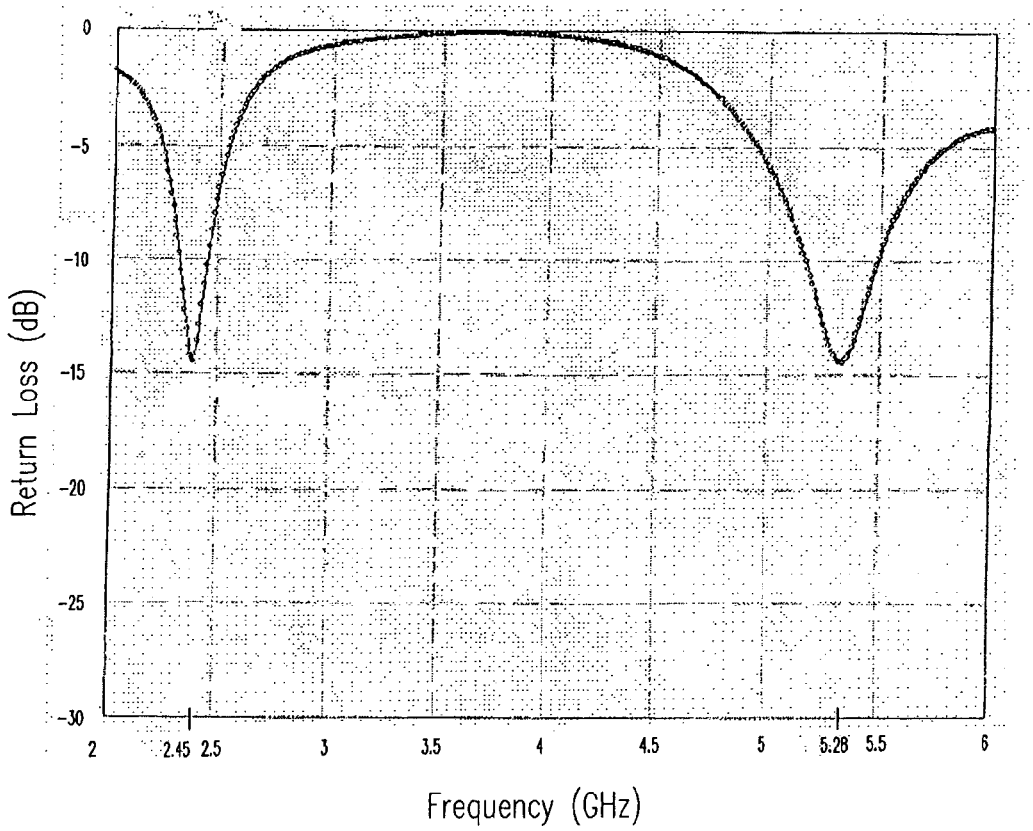
FIG. 3 shows a return loss vs. frequency graph pattern according to the multiple frequency band planar antenna of the first embodiment, as shown in FIG. 1A and FIG. 1B.
Figure 4:
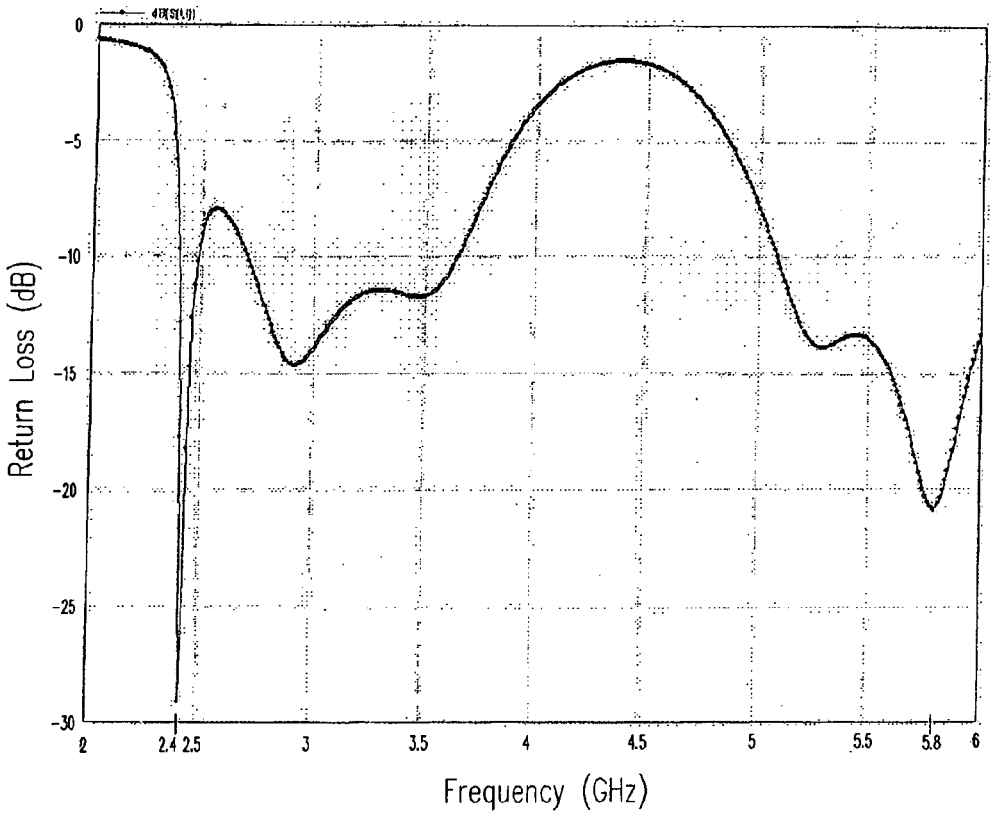
FIG. 4 shows a return loss vs. frequency graph pattern according to the multiple frequency band planar antenna of the second embodiment, as shown in FIG. 2 A and FIG. 2B.

As shown in FIG. 3, the MFB planar antennas of the first embodiment operates at two frequency bands, the central frequencies of which are 2.45 GHz and 5.28 GHz, respectively. Likewise, the MFB planar antennas of the second embodiment operates at three frequency bands, the central frequencies of which are 2.45 GHz, 3.5 GHz and 5.8 GHz, respectively, as shown in FIG. 4. Evidently, compared with U.S. Pat. No. 6,535,167 B2, not only does the central frequency of the frequency band of the present invention shift to the high-frequency side, but the number of the "frequency band" is increased as well. Accordingly, the characteristic of the MFB planar antenna operating at multiple frequency bands enables the antenna to be applied to both WIFi LAN and Wi MAX MAN applications.

Figure 5:
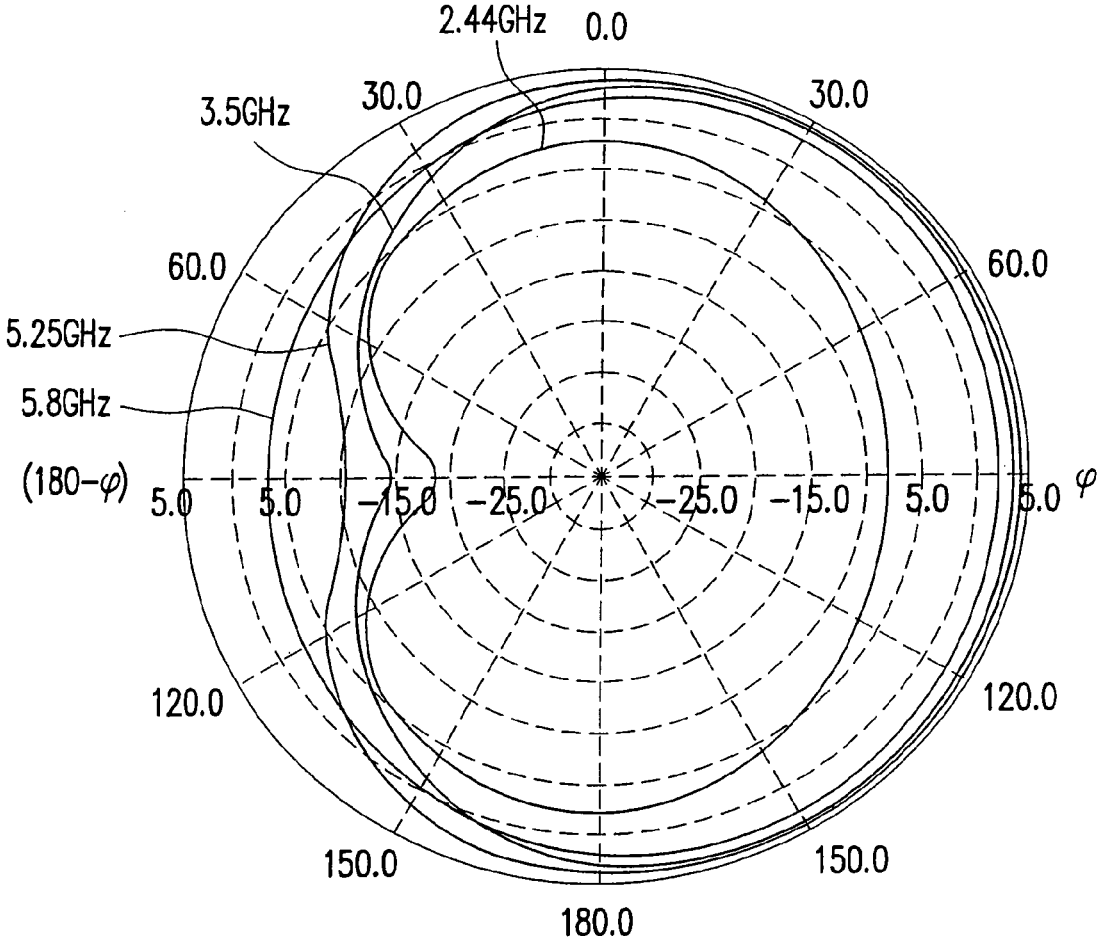
FIG. 5 shows radiation patterns of the multiple frequency band planar antennas of the second embodiment of the present invention operating at 2.4 GHz, 3.5 GHz, 5.25 GHz, and 5.8 GHz, in Y-Z planes.

Furthermore, FIG. 5 shows radiation patterns of the multiple frequency band planar antennas of the second embodiment of the present invention operating at 2.4 GHz, 3.5 GHz, 5.25 GHz, and 5.8 GHz, in Y-Z planes. All these radiation patterns are near omni-directional radiation that allows the users to conveniently use a wireless notebook or any wireless communication product that implements the MFB planar antennas of the first, second and third embodiments of the present invention.

In the first and the second embodiments of the present invention, although the MFB planar antenna is disposed in the reverse-side surface of the circuit board while the transmission line is disposed on the obverse-side surface thereof, they can also be disposed on the same side (the obverse-side) with a suitable via connecting to the ground.

In summary, the MFB planar antennas of the present invention have the following advantages:

1. The MFB planar antennas of the present invention can be well applied in both the WIFi LAN and the WiMAX MAN and thus provide the multiple frequency bands with their central frequencies ranging from 2.4 GHz to 5.8 GHz, instead of one frequency band with its 2.4 GHz central frequency in the conventional planar antenna. As a result, the MFB planar antennas of the present invention can be applied in the metropolitan area network so as to allow the wireless notebook users to access the internet at any place in the metropolitan area, without limitations to some fixed places, such as public buildings and train stations, when using the wireless notebook that implements the conventional planar antenna.
2. As the MFB planar antenna of the present invention has a simple structure, its fabricating procedures can be significantly simplified, thereby lowering its fabricating cost and promoting its production yield.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A multiple frequency band planar antenna formed on one-side surface of a circuit board, comprising:

a first antenna pattern, comprising a first elongated portion and a first conductor portion, wherein the first conductor portion is connected to a ground pattern; and a second antenna pattern, comprising a second elongated portion and a second conductor portion, the second conductor portion being connected at one end to one point between one end and another end of the first elongated portion and connected at another end to the end of the second elongated portion opposite to the open end thereof;

wherein the second elongated portion at a point between its two ends is short-circuited to a feeding transmission line formed on another-side surface of the circuit board through a via.

2. The multiple frequency band planar antenna according to claim 1, wherein the first and the second elongated portions are substantially parallel with an edge of circumference of the ground pattern.

3. The multiple frequency band planar antenna according to claim 2, wherein the first antenna pattern and the second antenna pattern are inverted-L-shaped patterns.

4. The multiple frequency band planar antenna according to claim 3, wherein the first antenna pattern serves as a monopole antenna, and the length of the first antenna pattern is equal to $\lambda/4$ of the 2.4 GHz.

5. The multiple frequency band planar antenna according to claim 3, wherein the first conductor portion, the first elongated portion, the second conductor portion, the second elongated portion and the ground pattern form a loop antenna, and the length of the loop antenna is equal to one wavelength of the 5.28 GHz frequency.

6. The multiple frequency band planar antenna according to claim 2, wherein the circuit board is a glass-epoxy or Teflon-glass circuit board.

7. A multiple frequency band planar antenna formed on one-side surface of a circuit board, comprising:

a first antenna pattern, comprising a first elongated portion and a first conductor portion, wherein the first conductor portion is connected to a ground pattern;

a second antenna pattern, comprising a second elongated portion and a second conductor portion, wherein the second conductor portion is connected at one end to one point between one end and another end of the first elongated portion and connected at another end to the end of the second elongated portion opposite to the open end thereof;

a third antenna pattern, comprising a third elongated portion and a third conductor portion, wherein the third conductor portion is connected at one end to one point between one end and another end of the first elongated portion and connected at another end to the end of the third elongated portion opposite to the open end thereof; and a fourth antenna pattern, comprising a fourth elongated portion and a fourth conductor portion, wherein the fourth conductor portion is connected at one end to an open end of the second elongated portion and connected at another end to the end of the fourth elongated portion opposite to the open end thereof;

wherein the second elongated portion at a point between its two ends is short-circuited to a feeding transmission line formed on another-side surface of the circuit board through a via.

8. The multiple frequency band planar antenna according to claim 7, wherein the first elongated portion, the second elongated portion, the third elongated portion and the fourth elongated portion are not overlapped and are substantially parallel with an edge of circumference of the ground pattern.

9. The multiple frequency band planar antenna according to claim 8, wherein the first antenna pattern, the second antenna pattern, the third antenna pattern and the fourth antenna pattern are inverted-L-shaped patterns.

10. The multiple frequency band planar antenna according to claim 9, wherein the first antenna pattern serves as a monopole antenna, and the length of the first antenna pattern is equal to $\lambda/4$ of the 2.4 GHz frequency.

11. The multiple frequency band planar antenna according to claim 9, wherein the multiple frequency band planar antenna is able to operate multiple frequency bands with their central frequencies ranging from 2.4 GHz to 5.8 GHz.

12. The multiple frequency band planar antenna according to claim 9, wherein the circuit board is a glass-epoxy or Teflon-glass circuit board.

* * * * *